US011661245B2

(12) United States Patent
Graber et al.

(10) Patent No.: US 11,661,245 B2
(45) Date of Patent: May 30, 2023

(54) COVER FOR BOTTLE, BOTTLE COMPRISING COVER AND METHODS

(71) Applicant: Billerudkorsnas AB, Solna (SE)

(72) Inventors: Klaus Graber, Nice (FR); Christophe Delrive, Mouvaux (FR)

(73) Assignee: BILLERUDKORSNAS AB, Solna (SE)

( * ) Notice: Subject to any disclaimer, the term of this patent is extended or adjusted under 35 U.S.C. 154(b) by 28 days.

(21) Appl. No.: 17/259,534

(22) PCT Filed: Jul. 3, 2019

(86) PCT No.: PCT/EP2019/067801
§ 371 (c)(1),
(2) Date: Jan. 11, 2021

(87) PCT Pub. No.: WO2020/011612
PCT Pub. Date: Jan. 16, 2020

(65) Prior Publication Data

US 2021/0269199 A1 Sep. 2, 2021

(30) Foreign Application Priority Data

Jul. 12, 2018 (EP) ..... 8183098

(51) Int. Cl.
*B65D 41/62* (2006.01)
*B65B 7/01* (2006.01)
(Continued)

(52) U.S. Cl.
CPC ..... *B65D 41/62* (2013.01); *B65B 7/01* (2013.01); *B65B 7/168* (2013.01); *B65D 65/38* (2013.01);
(Continued)

(58) Field of Classification Search
CPC ..... B65D 77/2028; B65D 2577/2041; B65D 2565/38; B65D 2565/381; B65D 41/62;
(Continued)

(56) References Cited

U.S. PATENT DOCUMENTS 4,545,494 A * 10/1985 Sawicki ..... B65D 41/62 215/257
5,119,965 A * 6/1992 Arduca ..... B65D 41/62 220/257.1
(Continued)

FOREIGN PATENT DOCUMENTS

GB 374799 A 6/1932
WO WO2017/149467 A1 1/2019

OTHER PUBLICATIONS

Material District: "Fibreform", Other naturals, Jan. 6, 2015 (Jan. 6, 2015), XP002787688, Retrieved from the Internet: URL:https://materialdistrict.com/material/ fi breform/.

*Primary Examiner* — Kareen K Thomas
(74) *Attorney, Agent, or Firm* — Stites & Harbison PLLC; Richard S. Myers, Jr.

(57) ABSTRACT

A cover (52) for protection of a neck (44) and a closure member (46) of a bottle (42), wherein the cover (52) comprises a sleeve (54); wherein the sleeve (54) comprises a stretchable paper material (12); wherein the sleeve (54) is configured to enclose the neck (44); and wherein the stretchability according to ISO 1924-3:2005 of the stretchable paper material (12) the sleeve (54) is at least 5% in the machine direction (MD) and at least 5% in the cross direction (CD). A bottle (42) comprising a cover (52), a method of forming a cover (52) for a bottle (42), and a method of attaching a cover (52) to a bottle (42), are also provided.

20 Claims, 7 Drawing Sheets

(51) Int. Cl.
*B65B 7/16* (2006.01)
*B65D 65/38* (2006.01)

(52) U.S. Cl.
CPC .. *B65D 2565/382* (2013.01); *B65D 2565/385* (2013.01)

(58) Field of Classification Search
CPC ..... B65D 65/38; B65D 2565/382; B65D 2565/385; B65B 29/10; B65B 61/184; B65B 61/182; B65B 61/12; B65B 7/01; B65B 7/168
See application file for complete search history.

(56) References Cited

U.S. PATENT DOCUMENTS

| | | | | |
|---|---|---|---|---|
| 5,654,022 | A * | 8/1997 | Sayre | B65D 41/62 426/118 |
| 5,924,739 | A * | 7/1999 | Garbutt | G09F 3/10 283/67 |
| 6,540,726 | B1 * | 4/2003 | Follman | B65D 41/62 604/294 |
| 6,691,439 | B1 * | 2/2004 | Miyashita | B65D 23/0878 40/310 |
| 2005/0039416 | A1 * | 2/2005 | Hidding | B65D 41/62 215/246 |
| 2008/0245825 | A1 * | 10/2008 | Kiser | B65D 77/06 222/105 |

* cited by examiner

COVER FOR BOTTLE, BOTTLE COMPRISING COVER AND METHODS

CROSS REFERENCE TO RELATED APPLICATIONS

This application is a § 371 National State Application of PCT/EP2019/067801 filed Jul. 3, 2019, which claims priority to EP 18183098.5 filed Jul. 12, 2018.

TECHNICAL FIELD

The present disclosure generally relates to a bottle cover comprising a stretchable paper material. In particular, a cover for protection of a neck and a closure member of a bottle, where a sleeve of the cover comprises a stretchable paper material, a bottle comprising a cover, a method of forming a cover for a bottle, and a method of attaching a cover to a bottle, are provided.

BACKGROUND

Almost all sparkling wine bottles are today "capped" with complex foils, for example made of aluminum and polyethylene (PE). These foil caps remain on the bottles after consumption and are generally not recycled separately. This poses enormous difficulties for the recycling process. A minority of the foil caps are recycled by energy intensive incineration.

The annual production of sparkling wines is today over 2.5 billion bottles. The total area of the foil caps may therefore be estimated to over 75 million $m^2$. The foil caps therefore pose a severe problem for the environment and for a sustainable development.

EP 1323640 A1 discloses a cover consisting of a truncated conical skirt and a preformed cap. The cap is pressed and cut from a strip of aluminum, and the cover is fitted with an opening system in the form of a tongue and a line of reduced resistance in the skirt.

SUMMARY

One object of the present disclosure is to provide a cover for a bottle, which cover is environmentally friendly.

A further object of the present disclosure is to provide a cover for a bottle, which cover is free from plastic and aluminium.

A still further object of the present disclosure is to provide a cover for a bottle, which cover is biodegradable, such as 100% biodegradable. A biodegradable cover refers to a cover that can be decomposed in the natural environment aerobically (e.g. composting) or anaerobically (e.g. landfill).

A still further object of the present disclosure is to provide a cover for a bottle, which cover can be easily attached to the bottle.

A still further object of the present disclosure is to provide a cover for a bottle, which cover can be easily opened.

A still further object of the present disclosure is to provide a cover for a bottle, which cover can be easily detached from the bottle.

A still further object of the present disclosure is to provide a bottle comprising a closure member and a cover, which bottle solves one, several or all of the foregoing objects.

A still further object of the present disclosure is to provide a method of forming a cover for a bottle, which method solves one, several or all of the foregoing objects.

A still further object of the present disclosure is to provide a method of attaching a cover to a bottle, which method solves one, several or all of the foregoing objects.

BillerudKorsnäs AB (Sweden) has marketed a highly stretchable paper under the name FibreForm® since 2009. The stretchability of FibreForm® allows it to replace, for example, plastics in many applications.

According to one aspect, there is provided a cover for protection of a neck and a closure member of a bottle, wherein the cover comprises a sleeve; wherein the sleeve comprises a stretchable paper material; wherein the sleeve is configured to enclose the neck; and wherein the stretchability according to ISO 1924-3:2005 of the stretchable paper material the sleeve is at least 5% in the machine direction (MD) and at least 5% in the cross direction (CD).

Due to the stretchability of the stretchable paper material of the sleeve, the cover can be tightly fitted around the neck of the bottle. The cover can thereby be made without any plastic or aluminium. The stretchable paper material of the sleeve also enables the environmentally friendly cover according to the present disclosure to be visually distinguished from prior art foil caps.

The cover according to the present disclosure may constitute a secondary protective cap-like outer cover for the neck and the closure member of the bottle. The sleeve may be formed around the neck and around at least a part of the closure member of the bottle. Throughout the present disclosure, the cover may alternatively be referred to as a cap or capsule and/or the sleeve may alternatively be referred to as a skirt.

The stretchable paper material according to the present disclosure may comprise at least one layer of stretchable paper. The stretchable paper layer may be composed of Kraft paper. The stretchable paper material may be constituted by a single layer of stretchable paper. Alternatively, the stretchable paper material according to the present disclosure may be constituted by a laminate or substrate of two or more layers of stretchable paper. In any case, the stretchable paper layer may be constituted by FibreForm® marketed by BillerudKorsnäs AB. FibreForm® is a formable, sustainable and tactile packaging material consisting of 100% primary fibers. The material's purity and strength are approved for contact with food. The material is 100% recyclable and 100% biodegradable to improve the overall environmental impact.

For aesthetic and printing purposes, the stretchable paper material according to the present disclosure may be white. For example, its brightness according to ISO 2470 may be at least 80%, such as at least 82%. However, the stretchable paper material may also be unbleached ("brown"). Throughout the present disclosure, the stretchable paper material may be either coated or uncoated.

The sleeve may be configured to attach to the neck by at least partial stretching of the stretchable paper material of the sleeve. The sleeve may be configured to attach to the neck by applying a pressure on the cover such that the stretchable paper material of the sleeve at least partly stretches. The pressure may for example be applied on the cover in a conventional bottle capping machine. The stretchable paper material enables an attachment to the neck without any glue. However, in order to increase the strength of attachment of the cover to the neck, glue may be added.

The grammage according to ISO 536:2012 of the stretchable paper material of the sleeve may be 20 $g/m^2$ to 300 $g/m^2$, such as 50 $g/m^2$ to 200 $g/m^2$, such as 80 $g/m^2$ to 120 g/m$^2$. According to one example, the grammage according to ISO 536:2012 of the stretchable paper material of the sleeve is 100 g/m$^2$.

The stretchable paper material of the sleeve may comprise a surface for printing. The surface for printing may be provided on a front surface and/or a rear surface of the stretchable paper material of the sleeve. A coated stretchable paper material has a significantly better surface for printing compared to an uncoated stretchable paper material.

The Bendtsen roughness according to ISO 8791-2 of at least one side of the stretchable paper material of the sleeve may be 2500 ml/min or lower, such as 2000 ml/min or lower, such as 1500 ml/min or lower. According to one example, the Bendtsen roughness according to ISO 8791-2 of a front side of the stretchable paper material of the sleeve is less than 1500 ml/min and the Bendtsen roughness according to ISO 8791-2 of a rear side of the stretchable paper material of the sleeve is less than 2500 ml/min. The Bendtsen roughness is typically lower when the grammage is lower. As understood by the skilled person, the above Bendtsen roughness values relate to uncoated paper.

The stretchable paper material of the sleeve may comprise at least one annular line of weakness for removal of an upper portion of the cover after tearing the at least one annular line of weakness. According to one example, the stretchable paper material of the sleeve comprises two annular lines of weakness. In this case, a portion between the annular lines of weakness constitutes an intermediate portion of the cover. After pulling a tab of the intermediate portion and tearing the two annular lines of weakness, an upper portion of the cover can be removed. As an alternative, the stretchable paper material of the sleeve may comprise only one annular line of weakness. In this case, the upper portion may be twisted to separate the upper portion from a lower portion of the cover along the annular line of weakness.

The stretchable paper material of the sleeve may comprise at least one longitudinal line of weakness for opening a lower portion of the cover after tearing the at least one longitudinal line of weakness. The stretchable paper material of the sleeve may further comprise an opening, and one of the at least one annular line of weakness and one of the at least one longitudinal line of weakness may join the opening. Throughout the present disclosure, each line of weakness may for example be constituted by a perforation line.

The stretchability further enables formation of three-dimensional shapes in the stretchable paper material of the sleeve, e.g. by press forming, or vacuum forming. The stretchable paper material of the sleeve may comprise at least one embossed structure. The cover may constitute a decorative cover for the bottle. Throughout the present disclosure, an embossed structure may for example be constituted by, or comprise, a bulge or relief.

Throughout the present disclosure, the cover may comprise a head attached to the sleeve, for example by means of glue. In this case, the head may or may not comprise a stretchable paper material. According to one example, the head is entirely made of a stretchable paper material. The stretchable paper material of the head may be of the same type as the stretchable paper material of the sleeve. In case the head is made of paper, the entire cover may be made of paper. The sleeve may radially enclose the head (with respect to a longitudinal axis of the sleeve).

In case the head comprises a stretchable paper material, the head may be configured to form over the closure member of the bottle, i.e. such that the shape of the head adopts, or substantially adopts, a shape of the closure member. The head may be configured to form over the closure member by applying a pressure on the cover such that the stretchable paper material of the head at least partly stretches. The pressure may for example be applied on the cover in a conventional bottle capping machine.

According to a further aspect, there is provided a bottle comprising a neck, closure member and a cover according to the present disclosure attached to the neck. A bottle according to the present disclosure may be of any type having a neck and a closure member, such as a bottle for champagne, sparkling wine or beer. The bottle may be made of glass.

According to a further aspect, there is provided a method of forming a cover for a bottle, the method comprising providing a blank of a stretchable paper material, wherein the stretchability according to ISO 1924-3:2005 of the stretchable paper material is at least 5% in the machine direction (MD) and at least 5% in the cross direction (CD); and forming the blank into a sleeve configured to enclose a neck of the bottle. The method may further comprise attaching a head to the sleeve, for example by means of gluing. The sleeve may comprise a stretchable paper material of the same type or similar type as the stretchable paper material of the sleeve. In particular, the sleeve may comprise a stretchable paper material having a stretchability according to ISO 1924-3:2005 of at least 5% in the machine direction (MD) and at least 5% in the cross direction (CD)

According to a further aspect, there is provided a method of attaching a cover to a bottle, the method comprising providing a cover according to the present disclosure; arranging the cover around a neck of the bottle; and attaching the cover to the neck.

The method may further comprise at least partially stretching the stretchable paper material of the sleeve such that the sleeve attaches to the neck. The method may further comprise at least partially stretching the stretchable paper material of the head such that the head forms over the closure member. The stretching of the sleeve and the head may take place simultaneously.

The method may further comprise applying a pressure on the cover such that the stretchable paper material at least partially stretches during the attachment of the cover to the neck. The pressure may be applied over several, such as four, annular regions of the sleeve such that radial folds are created between the annular regions and such that the annular regions of the sleeve are stretched. In this case, the method may further comprise folding the folds towards the neck of the bottle. The pressure may also be applied onto the head such that the head forms over the closure member.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1:
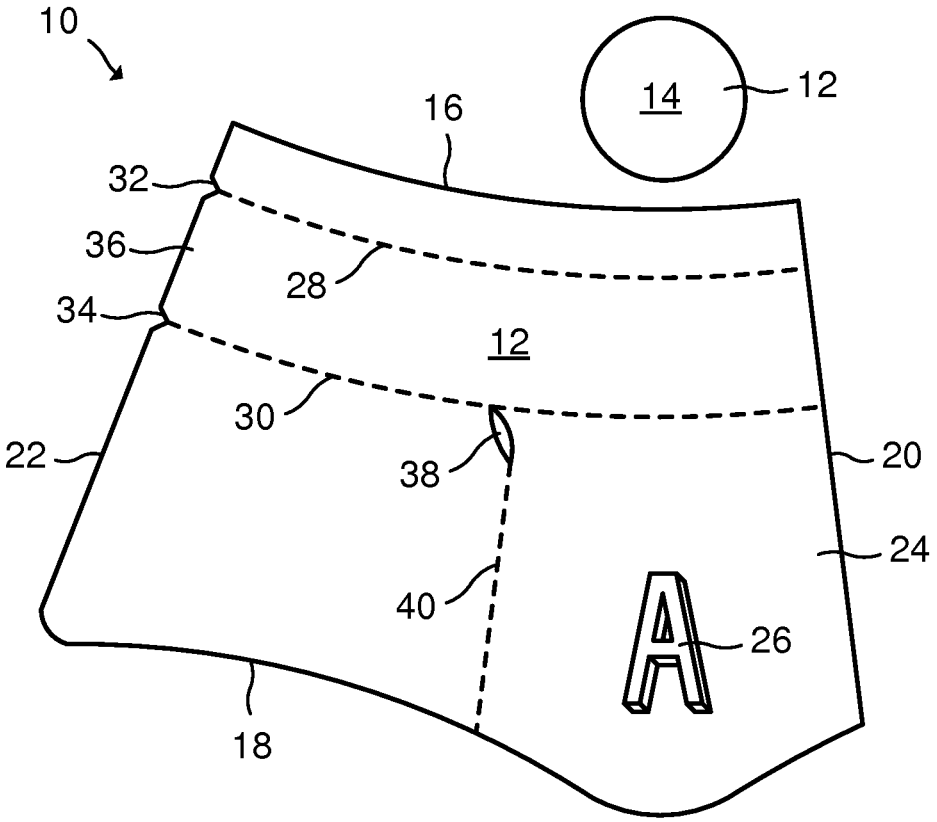
FIG. 1: schematically represents a plan view of a blank and a head of a stretchable paper material.

In the following, a cover for protection of a neck and a closure member of a bottle, where a sleeve of the cover comprises a stretchable paper material, a bottle comprising a cover, a method of forming a cover for a bottle, and a method of attaching a cover to a bottle, will be described. The same reference numerals will be used to denote the same or similar structural features.

FIG. 1 schematically represents a plan view of a blank 10 of a stretchable paper material 12 and a head 14. The stretchability according to ISO 1924-3:2005 of the stretchable paper material 12 is at least 5% in the machine direction (MD) and at least 5% in the cross direction (CD). The stretchable paper material 12 of this example comprises a single sheet of FibreForm® marketed by BillerudKorsnäs AB. In this example, the head 14 is also formed of the same stretchable paper material 12. However, the head 14 may alternatively be formed of a different material, e.g. a non-stretchable material. The head 14 forms a circular element.

The blank 10 is cut, e.g. die cut, into a generally trapezoidal shape. The blank 10 of this example comprises a upper edge 16, a lower edge 18, a first side edge 20 and a second side edge 22. In the example in FIG. 1, the upper edge 16 forms a single curve and the lower edge 18 forms two adjoining curves. The lower edge 18 may alternatively form a single curve.

The grammage according to ISO 536:2012 of the stretchable paper material 12 may for example be 80 g/m$^2$ to 120 g/m$^2$, such as 100 g/m$^2$. The stretchable paper material 12 of this example further comprises a surface for printing 24 at least on its front side. A surface for printing may alternatively, or in addition, be provided on the rear side of the stretchable paper material 12. The Bendtsen roughness according to ISO 8791-2 of the front side of the stretchable paper material 12 may be 1500 ml/min or lower, and the Bendtsen roughness according to ISO 8791-2 of the rear side of the stretchable paper material 12 may be 2500 ml/min or lower. The front side and/or the rear side of the stretchable paper material 12 may be printed, for example with a QR code or information related to a champagne house.

The blank 10 of the example in FIG. 1 further comprises an embossed structure 26 provided in the stretchable paper material 12. The embossed structure 26 is here exemplified as a relief. The embossed structure 26 may for example be formed by various types of press-forming, e.g. by means of a flat or cylindrical tool (not shown).

The blank 10 is further provided with two annular lines of weakness 28, 30. The lines of weakness 28, 30 are referred to as annular since they may extend circumferentially around a sleeve of the cover formed from the blank 10, as will be described later. Two V-shaped incisions 32, 34 are formed at the second side edge 22 of the blank 10, one at each end of the two annular lines of weakness 28, 30. Thereby, a tab 36 is formed on the second side edge 22 of the blank 10 between the two incisions 32, 34.

The blank 10 further comprises an opening 38, here implemented as a through hole (e.g. punched), and a longitudinal line of weakness 40. The line of weakness 40 is referred to as longitudinal since it may extend substantially parallel with a longitudinal axis of a bottle (and of a sleeve formed of the blank 10). In this example, the longitudinal line of weakness 40 is substantially perpendicular to the second annular line of weakness 30 and extends all the way to the lower edge 18 of the blank 10.

The opening 38 of the example in FIG. 1 has an elliptical shape with its major axis tilted approximately 30° with respect to the longitudinal line of weakness 40. The second annular line of weakness 30 extends via the opening 38, or close to the opening 38. The longitudinal line of weakness 40 extends all the way to the opening 38, or close to the opening 38. The annular line of weakness 30 and the longitudinal line of weakness 40 thereby join the opening 38.

In the example in FIG. 1, each of the two annular lines of weakness 28, 30 and the longitudinal line of weakness 40 is constituted by a perforation line. However, alternative lines of weakness are possible.

Figure 2:
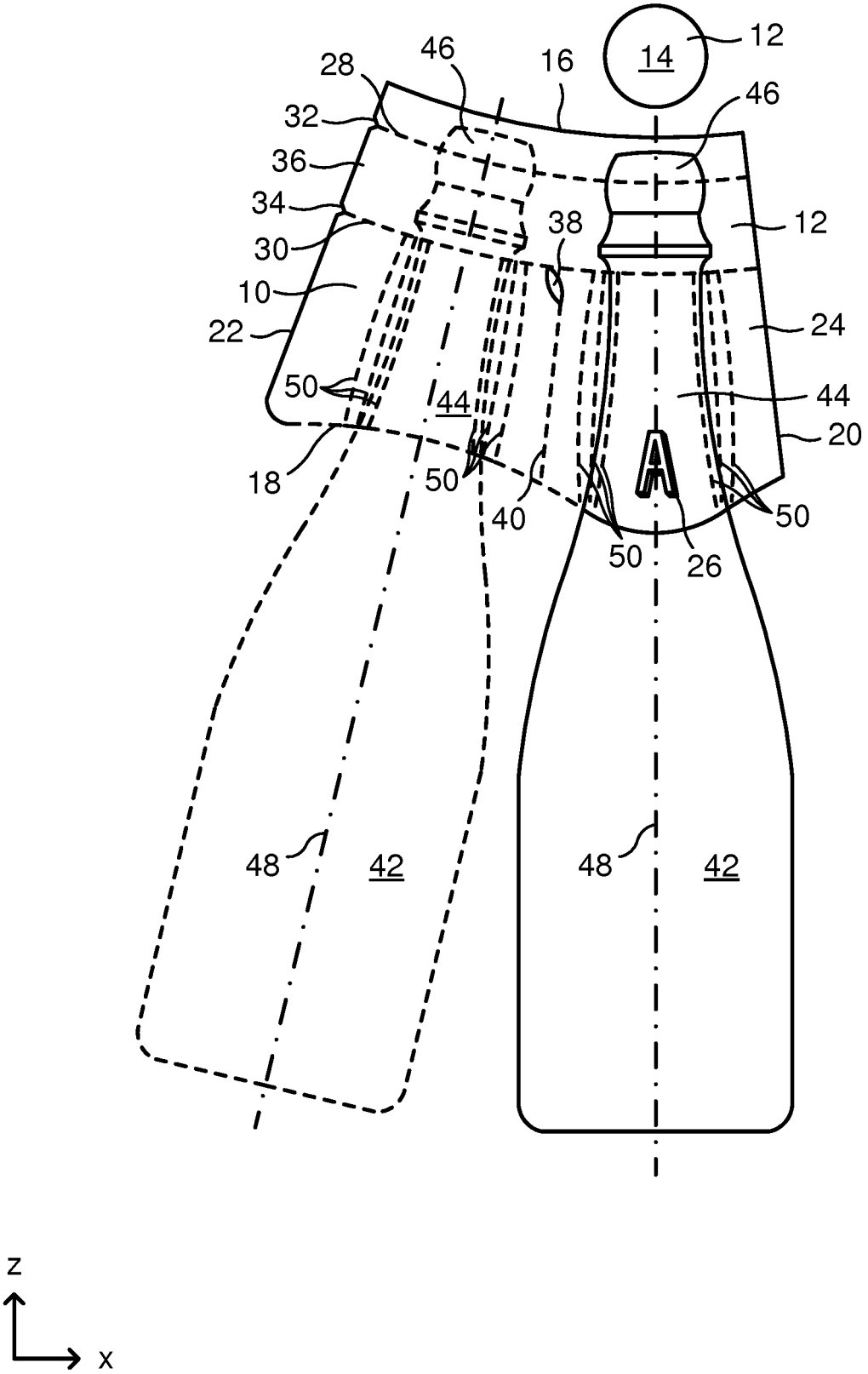
FIG. 2: schematically represents a front view of a bottle and the blank.

FIG. 2 schematically represents a front view of a bottle 42 and the blank 10 in FIG. 1. The bottle 42 may for example be constituted by a glass bottle 42 for champagne or sparkling wine. The bottle 42 comprises a neck 44 and a closure member 46, such as a champagne cork.

FIG. 2 illustrates the relationships between the bottle 42 and the blank 10. The bottle 42 illustrated with solid lines and dashed lines represent the relationships between the blank 10 and the bottle 42 from a front side and a rear side, respectively. FIG. 2 further shows a Cartesian coordinate system for referencing purposes and a longitudinal axis 48 of the bottle 42.

In FIG. 2, fold lines 50 are illustrated on the blank 10. The fold lines 50 in this example merely indicate where the stretchable paper material 12 will fold (see FIG. 5). The fold lines 50 may however optionally be pre-scored.

Figure 3:
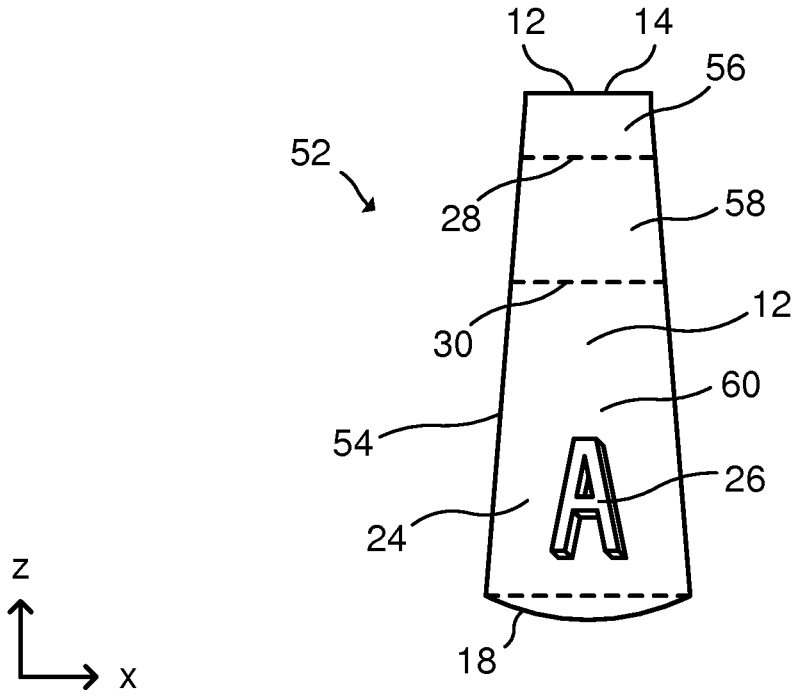
FIG. 3: schematically represents a front view of a cover comprising a sleeve formed from the blank and the head.

FIG. 3 schematically represents a front view of a cover 52 comprising a sleeve 54 formed from the blank 10 and the head 14 attached to the sleeve 54, for example by means of gluing. The sleeve 54 has a gradually increasing diameter (from top to bottom) and is configured to enclose the neck 44 of the bottle 42. The head 14 has a diameter slightly larger than a top portion of the closure member 46. In the example in FIG. 3, the sleeve 54 is formed by folding the blank 10 over itself, e.g. such that the second side edge 22 overlaps the first side edge 20 of the blank 10. The second side edge 22 may for example be attached to the first side edge 20 by means of glue. In this case, the tab 36 of the stretchable paper material 12 may not be glued to the first side edge 20.

Furthermore, in the example in FIG. 3, the blank 10 is rolled around the head 14 and the top of the blank 10 may be folded towards the top of the head 14. Optionally, glue may be added to more securely attach the head 14 to the rolled blank 10. As shown in FIG. 3, the sleeve 54 of the cover 52 has a general shape of a truncated cone with a relatively wide base and a relatively narrow top. The cover 52 as shown in FIG. 3 may be produced by a paper converter.

As shown in FIG. 3, the cover 52 comprises an upper portion 56 above the first annular line of weakness 28. The upper portion 56 of this example thus comprises the head 14 and a part of the sleeve 54. The cover 52 further comprises an intermediate portion 58 between the two annular lines of weakness 28, 30, and a lower portion 60 below the second annular line of weakness 30.

Figure 4:
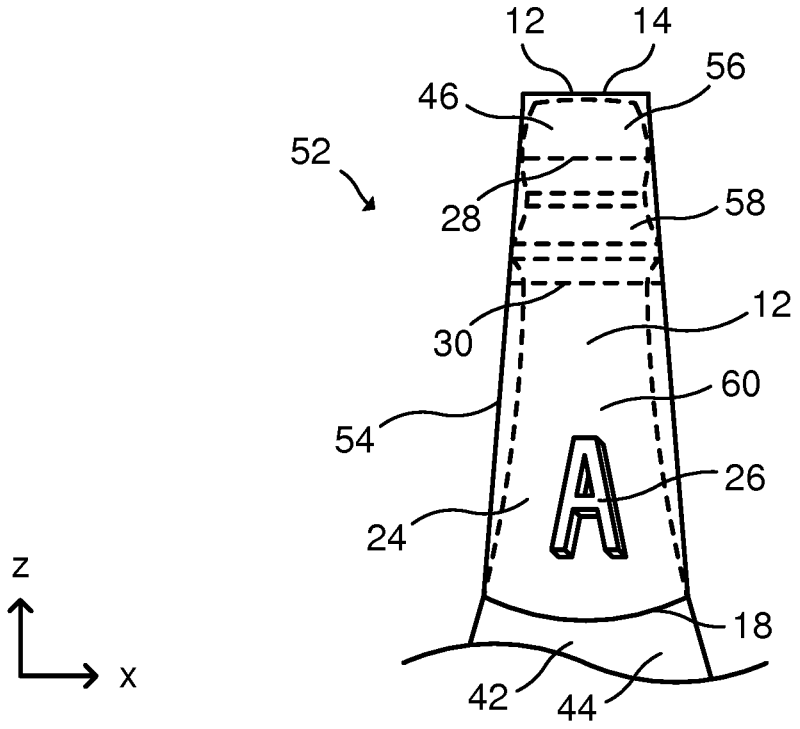
FIG. 4: schematically represents a front view of the cover arranged around a neck of the bottle.

FIG. 4 schematically represents a front view of the cover 52 arranged around the neck 44 of the bottle 42. The cover 52 is slid over the neck 44 along the longitudinal axis 48 (see FIG. 2) of the bottle 42. Thereby, the sleeve 54 covers the neck 44 and the sleeve 54 and the head 14 together cover the closure member 46 of the bottle 42.

Figure 5:
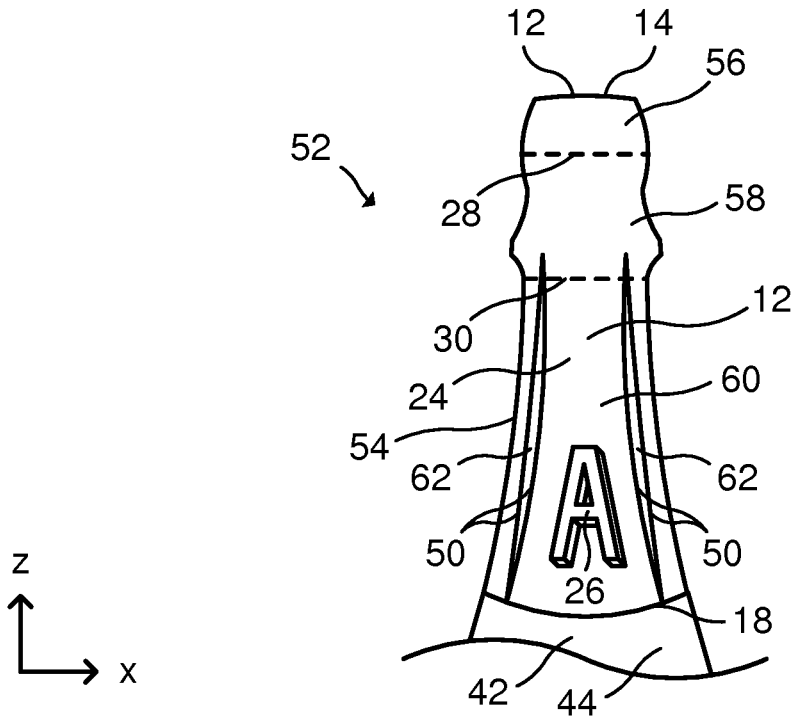
FIG. 5: schematically represents a front view of the cover attached to the bottle.

FIG. 5 schematically represents a front view of the cover 52 attached to the bottle 42. The cover 52 has been pressed towards the neck 44 such that the sleeve 54 forms a tight fit around the neck 44. This tight fit is enabled due to the stretchability of the stretchable paper material 12. Furthermore, when pressing the cover 52, the head 14 is formed to adopt a shape corresponding to the shape of an upper surface of the closure member 46. In the example in FIG. 5, the head 14 is slightly curved. The cover 52 may for example be pressed towards the neck 44 and towards the closure member 46 in a conventional capping machine (not shown) for foil caps. In this case, four folds 62 on the sleeve 54 are formed automatically by folding along the fold lines 50.

Due to the stretching of the stretchable paper material 12 of the sleeve 54 around the neck 44, the cover 52 closely conforms to the shape of the neck 44 and the side of the closure member 46. The circumferential stretching of the stretchable paper material 12 of the sleeve 54 around the neck 44 and around the closure member 46 also contributes to a firm attachment of the cover 52 to the bottle 42. In FIG. 5, at least the annular regions of the stretchable paper material 12 of the sleeve 54 between the folds 62 are stretched. Optionally, glue may be added to increase the attachment strength between the cover 52 and the neck 44. The glue may be sprayed on the neck 44 and/or on the inside of the cover 52, e.g. prior to sliding the cover 52 over the neck 44. One example of suitable glue is alimentary glue.

Furthermore, due to the stretching of the stretchable paper material 12 of the head 14 over the closure member, the cover 52 also closely conforms to the shape of the top of the closure member 46. Also this stretching of the stretchable paper material 12 of the head 14 contributes to a firm attachment of the cover 52 to the bottle 42.

Figure 6:
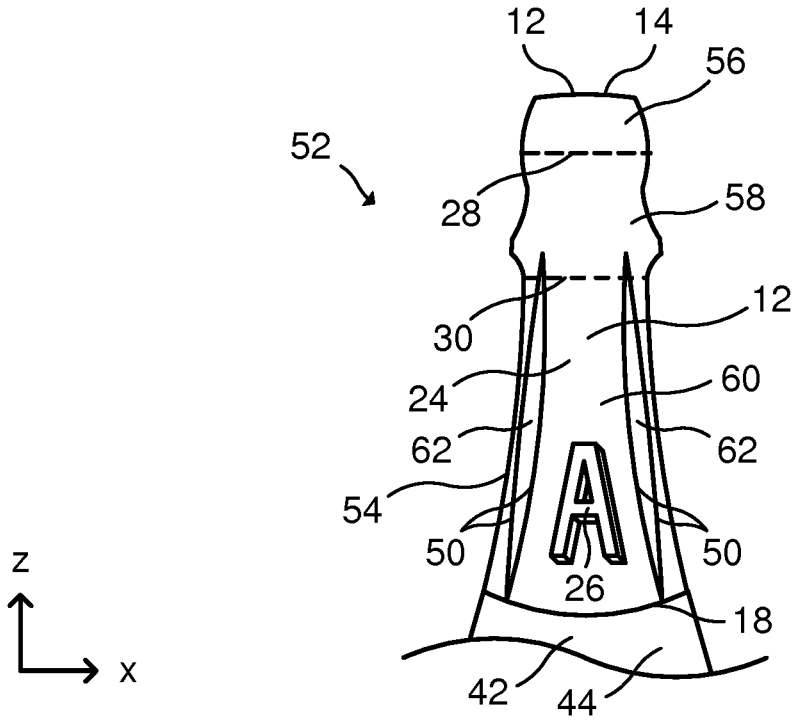
FIG. 6: schematically represents a front view of the bottle and the cover after a folding process.

FIG. 6 schematically represents a front view of the bottle 42 and the cover 52 after a folding process. In this folding process, the four radially protruding folds 62 of the sleeve 54 are folded towards the neck 44. The folding process may for example be carried out in a conventional folding machine (not shown) for foil caps. As can be seen in FIG. 6, the left and right folds 62 are folded to the left and right, respectively.

The attachment of the cover 52 to the bottle 42 as described in FIGS. 4-6 is typically carried out at a wine house. The attachment of the cover 52 may be carried out automatically or manually. Automatic attachment of the cover 52 may be carried out with existing machinery for foil caps. Manual attachment of the cover 52 may be carried out by manually holding the bottle 42 and inserting the neck 44 with a cover 52 slid thereover into a pressing machine (not shown) such that the cover 52 is attached to the neck 44 according to FIG. 5. The neck 44 with the cover 52 attached thereto may then optionally be inserted into a folding machine (not shown) while manually holding the bottle 42 such that the cover 52 is folded according to FIG. 6.

Trials with a cover 52 comprising a sleeve 54 and a head 14 of a stretchable paper material 12 of FibreForm® have been carried out. In these trials, the forming of the cover 52 went well and there was no cracking.

Figure 7:
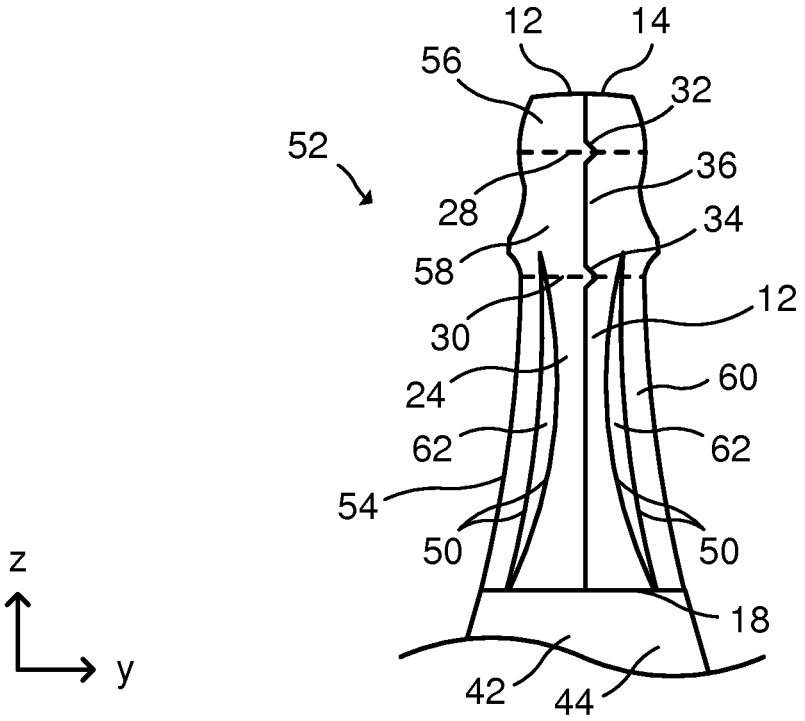
FIG. 7: schematically represents a side view of the bottle and the cover in FIG. 6.

FIG. 7 schematically represents a side view of the bottle 42 and the cover 52 in FIG. 6. As can be seen in FIG. 7, the tab 36 is exposed for tearing of the cover 52. In order to open the cover 52, a user may pull a tab 36 of the cover 52 between the two annular lines of weakness 28, 30 and tear the cover 52.

Figure 8:
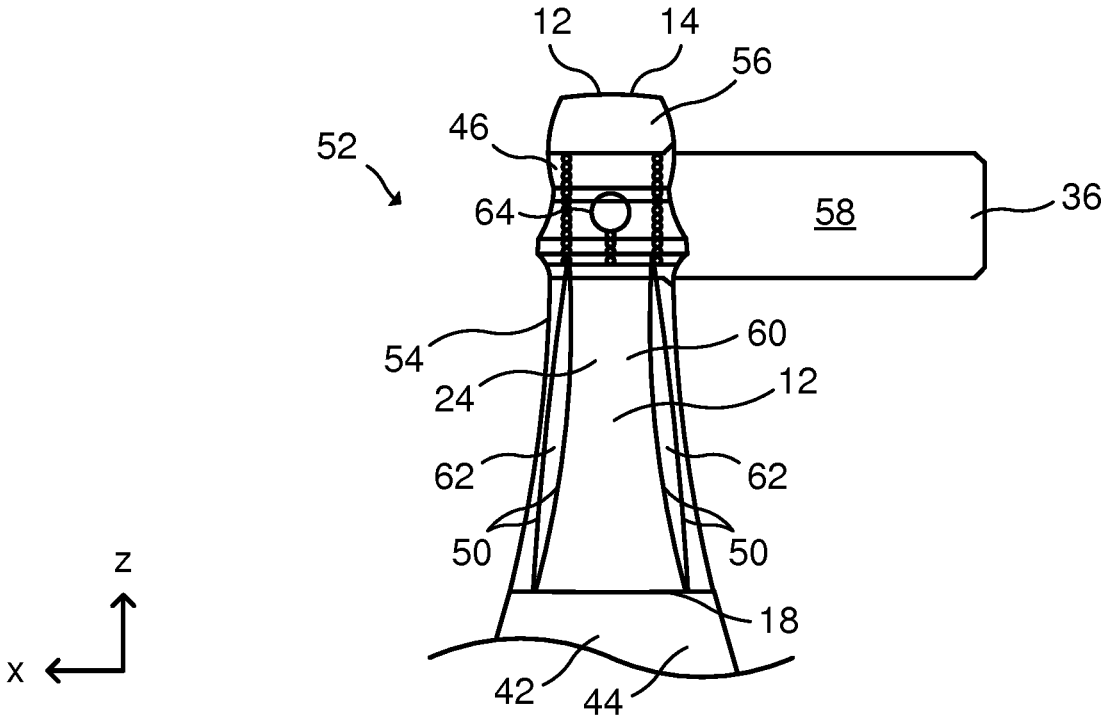
FIG. 8: schematically represents a rear view of the bottle and the cover when being torn.

FIG. 8 schematically represents a rear view of the bottle 42 and the cover 52 when being torn. By pulling the tab 36, the intermediate portion 58 of the cover 52 can be separated from the upper portion 56 along the first annular line of weakness 28, and can be separated from the lower portion 60 of the cover 52 along the second annular line of weakness 30. As illustrated in FIG. 8, a conventional wiring 64 for holding the closure member 46 is thereby exposed.

Figure 9:
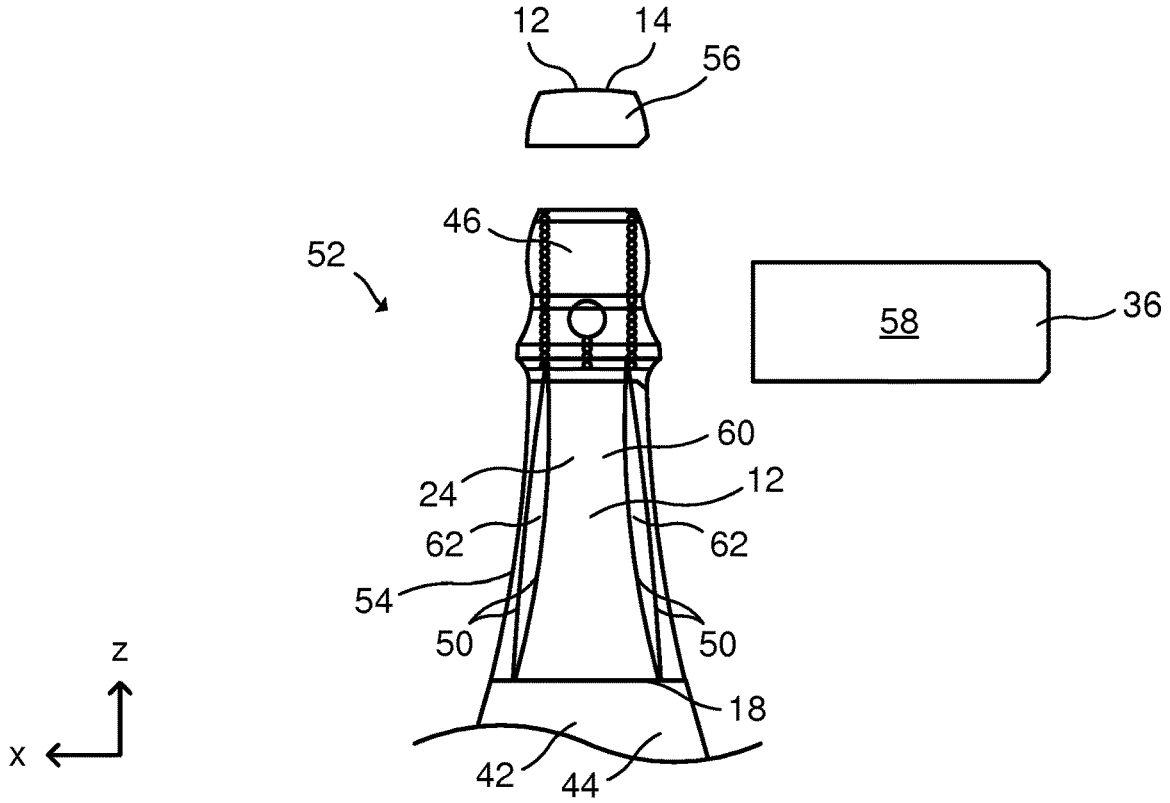
FIG. 9: schematically represents a rear view of the bottle and the cover during removal of an upper portion and an intermediate portion of the cover.

FIG. 9 schematically represents a rear view of the bottle 42 and the cover 52 during removal of the upper portion 56 and the intermediate portion 58 of the cover 52. After removal of the upper portion 56 and the intermediate portion 58, the closure member 46 may be opened for consumption of the content of the bottle 42 and the upper portion 56 and the intermediate portion 58 may be recycled.

Figure 10:
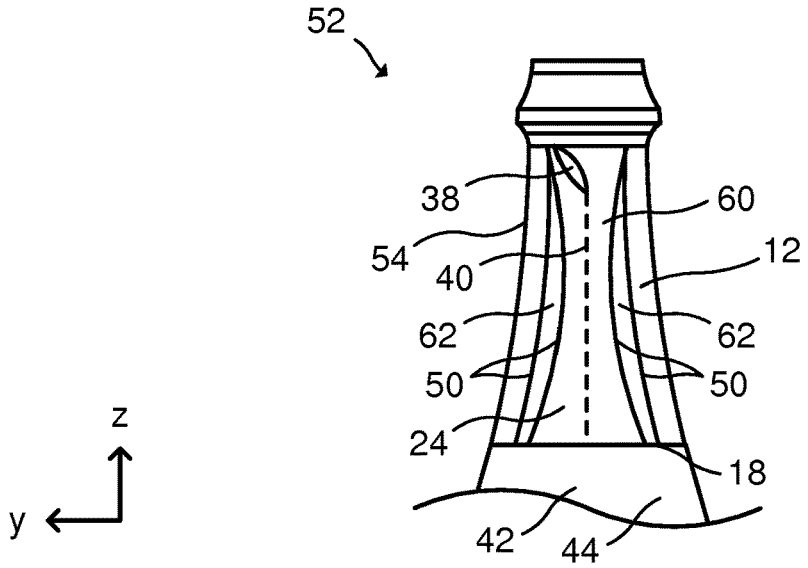
FIG. 10: schematically represents a side view of the bottle and the cover.

FIG. 10 schematically represents a side view of the bottle 42 and the cover 52. As can be seen in FIG. 10, the opening 38 is exposed when the intermediate portion 58 has been removed. In order to remove the remainder of the cover 52 from the bottle 42, i.e. the lower portion 60, the user may tear the lower portion **6*o* from the opening 38 and along the longitudinal line of weakness 40**.

Figure 11:
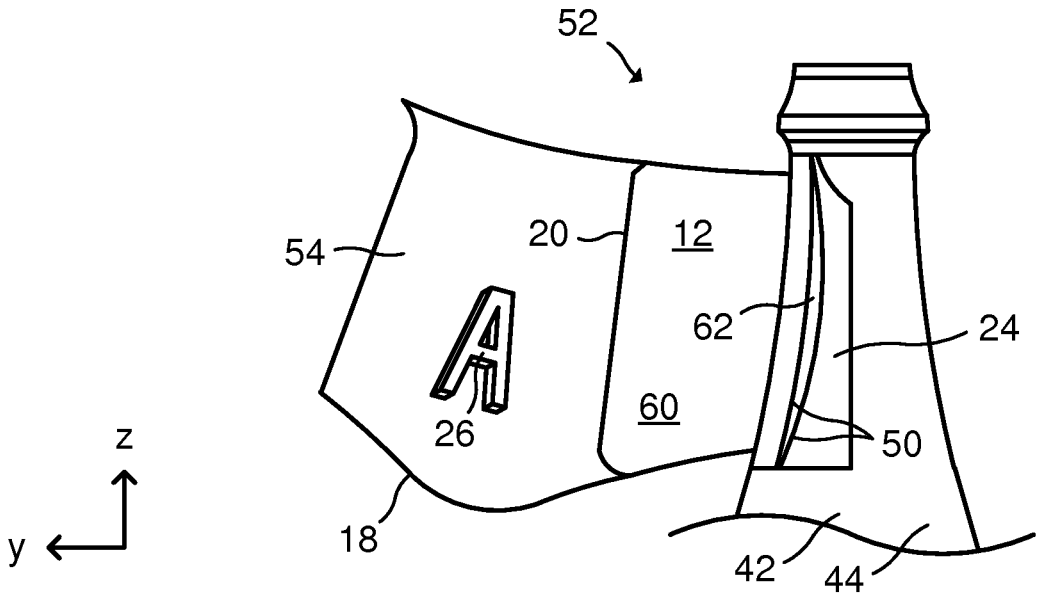
FIG. 11: schematically represents a side view of the bottle and the cover during removal of a lower portion of the cover.
Figure 12:
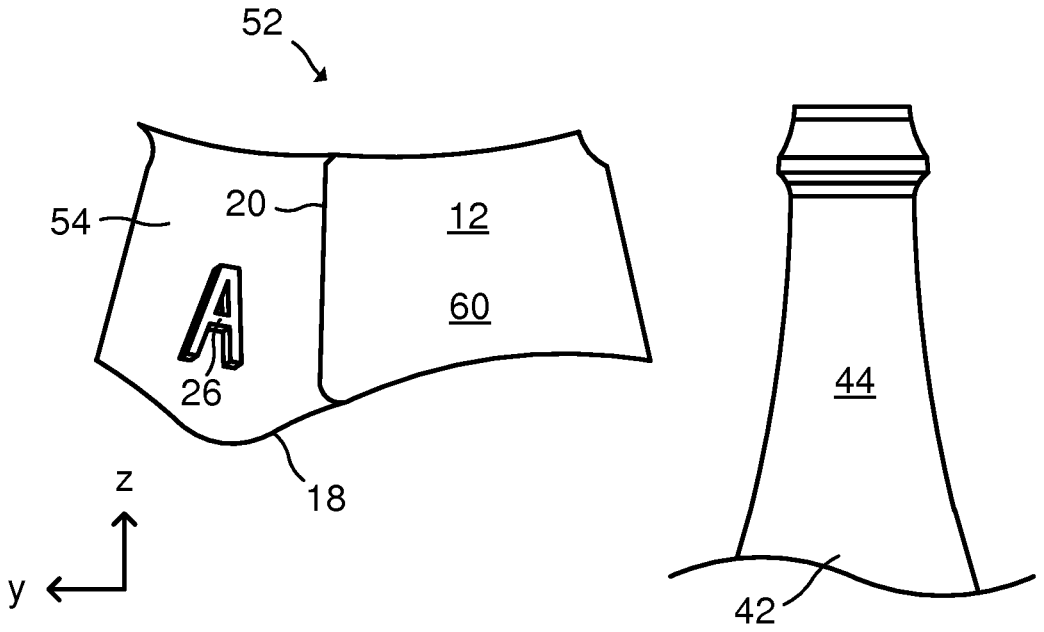
FIG. 12: schematically represents a side view of the bottle and the cover after removal of the lower portion of the cover.

FIG. 11 schematically represents a side view of the bottle 42 and the cover 52 during removal of the lower portion **6*o* of the cover 52 and FIG. 12 schematically represents a side view of the bottle 42 and the cover 52 after removal of the lower portion 6*o* of the cover 52. As shown in FIG. 12, the cover 52 can be completely separated from the bottle 42 and a separate recycling of the cover 52 and the bottle 42** is made easy.

While the present disclosure has been described with reference to exemplary embodiments, it will be appreciated that the present invention is not limited to what has been described above. For example, it will be appreciated that the dimensions of the parts may be varied as needed.

The invention claimed is:

1. A cover (52) for protection of a neck (44) and a closure member (46) of a bottle (42), wherein the cover (52) comprises a sleeve (54); wherein the sleeve (54) comprises a stretchable paper material (12); wherein the sleeve (54) is configured to enclose the neck (44); and wherein the stretchability, according to ISO 1924-3:2005 of the stretchable paper material (12) the sleeve (54), is at least 5% in the machine direction (MD) and at least 5% in the cross direction (CD).

2. The cover (52) according to claim 1, wherein the sleeve (54) is configured to attach to the neck (44) by at least partial stretching of the stretchable paper material (12) of the sleeve (54).

3. The cover (52) according to claim 1, wherein the grammage according to ISO 536:2012 of the stretchable paper material (12) of the sleeve (54) is 30 $g/m^2$ to 300 $g/m^2$.

4. The cover (52) according to claim 1, wherein the stretchable paper material (12) of the sleeve (54) comprises a surface for printing (24).

5. The cover (52) according to claim 1, wherein the Bendtsen roughness according to ISO 8791-2 of at least one side of the stretchable paper material (12) of the sleeve (54) is 2500 ml/min or lower.

6. The cover (52) according to claim 1, wherein the stretchable paper material (12) of the sleeve (54) comprises at least one annular line of weakness (28, 30) for removal of an upper portion (56) of the cover (52) after tearing the at least one annular line of weakness (28, 30).

7. The cover (52) according to claim 6, wherein the stretchable paper material (12) of the sleeve (54) comprises at least one longitudinal line of weakness (40) for opening a lower portion (60) of the cover (52) after tearing the at least one longitudinal line of weakness (40).

8. The cover (52) according to claim 7, wherein the stretchable paper material (12) of the sleeve (54) comprises an opening (38), and wherein one of the at least one annular line of weakness (28, 30) and one of the at least one longitudinal line of weakness (40) join the opening (38).

9. The cover (52) according to claim 1, wherein the stretchable paper material (12) of the sleeve (54) comprises at least one embossed structure (26).

10. The cover (52) according to claim 1, further comprising a head (14) attached to the sleeve (54), wherein the head (14) comprises a stretchable paper material (12).

11. A bottle (42) comprising a neck (44), a closure member (46) and a cover (52) according claim 1 attached to the neck (44).

12. A method of attaching a cover (52) to a bottle (42), the method comprising:

providing a cover (52) according to claim 1;

arranging the cover (52) around a neck (44) of the bottle (42); and attaching the cover (52) to the neck (44).

13. The method according to claim 12, further comprising at least partially stretching the stretchable paper material (12) of the sleeve (54) such that the sleeve (54) attaches to the neck (44).

14. The method according to claim 12, further comprising applying a pressure on the cover (52) such that the stretchable paper material (12) of the sleeve (54) at least partially stretches during the attachment of the cover (52) to the neck (44).

15. The method according to claim 13, further comprising applying a pressure on the cover (52) such that the stretchable paper material (12) of the sleeve (54) at least partially stretches during the attachment of the cover (52) to the neck (44).

16. The cover (52) according to claim 3, wherein the grammage according to ISO 536:2012 of the stretchable paper material (12) of the sleeve (54) is 50 $g/m^2$ to 200 $g/m^2$.

17. The cover (52) according to claim 3, wherein the grammage according to ISO 536:2012 of the stretchable paper material (12) of the sleeve (54) is 80 $g/m^2$ to 120 $g/m^2$.

18. The cover (52) according to claim 5, wherein the Bendtsen roughness according to ISO 8791-2 of at least one side of the stretchable paper material (12) of the sleeve (54) is 2000 ml/min or lower.

19. The cover (52) according to claim 5, wherein the Bendtsen roughness according to ISO 8791-2 of at least one side of the stretchable paper material (12) of the sleeve (54) is 1500 ml/min or lower.

20. A method of forming a cover (52) for a bottle (42), the method comprising:

providing a blank (10) of a stretchable paper material (12), wherein the stretchability according to ISO 1924-3:2005 of the stretchable paper material (12) is at least 5% in the machine direction (MD) and at least 5% in the cross direction (CD); and forming the blank (10) into a sleeve (54) configured to enclose a neck (44) of the bottle (42).

* * * * *